US005679893A

United States Patent [19]

Masoner

[11] Patent Number: 5,679,893

[45] Date of Patent: Oct. 21, 1997

[54] DETERMINING THE OIL DECLINE FOR AN OIL-PRODUCING RESERVOIR

[75] Inventor: Lance O. Masoner, Rangely, Colo.

[73] Assignee: Chevron, U.S.A., Inc., San Francisco, Calif.

[21] Appl. No.: 599,889

[22] Filed: Feb. 12, 1996

[51] Int. Cl.[6] ..... E21B 47/00

[52] U.S. Cl. ..... 73/152.18

[58] Field of Search ..... 73/152.18, 152.29; 166/250.01; 364/420

[56] References Cited

PUBLICATIONS

Bradley, Howard B., *Petroleum Engineering Handbook*, Society of Petroleum Engineers, Second Printing, 1987, pp. 40–26 –40–29.

Fetkovich, M.J. et al., "Useful Concepts for Decline Curve Forecasting, Reserve Estimation, and Analysis", SPE 29628, SPE Technical Conference and Exhibition, Sep. 1994, pp. 217–232.

*Primary Examiner*—Michael Brock

*Attorney, Agent, or Firm*—Rodney F. Brown

[57] ABSTRACT

A method of determining the corrected oil decline for an oil-producing reservoir is provided. The values of a plurality of variables are determined including the total processing rate for the reservoir at an initial time denoting the beginning of an elapsed production time period, the total processing rate for the reservoir at a first selected time after the initial time, the oil processing rate for the reservoir at the initial time, the cumulative quantity of total fluids produced from the reservoir between the initial time and the first selected time, the oil processing rate for a given oil saturation level of the reservoir at the first selected time, and the ratio of non-oil fluids to oil for all fluids produced from the reservoir at the first selected time. The values of these variables are then employed in a system of equations to calculate the corrected oil processing rate at the first selected time. A second time after the initial time is selected thereafter and the same steps are repeated for this second selected time. The corrected oil processing rate at the first selected time and the corrected oil processing rate at the second selected time are used to define the corrected oil decline for the reservoir.

27 Claims, 2 Drawing Sheets

DETERMINING THE OIL DECLINE FOR AN OIL-PRODUCING RESERVOIR

TECHNICAL FIELD

The present invention relates generally to rate-time analysis for oil-producing reservoirs, and more particularly to a method of determining oil decline for an oil-producing reservoir, wherein the total processing rate of the reservoir can vary over time.

BACKGROUND OF THE INVENTION

Rate-time analysis is an empirical method of determining the oil decline for a reservoir producing oil by means of a particular recovery process. The oil decline for the reservoir can subsequently be used to estimate the remaining oil reserves in the reservoir and/or the remaining productive life of the reservoir. Conventional methods for rate-time analysis are disclosed in *Petroleum Engineering Handbook*, Society of Petroleum Engineers, Second Printing, beginning at p. 40–26, and incorporated herein by reference. Such conventional methods are generally only valid where both the recovery process and the volume of fluids in the reservoir being impacted by the recovery process remain essentially constant. Conventional methods for rate-time analysis also inherently assume that the volumetric rate at which fluids are being produced from the reservoir, termed the total processing rate, remains constant throughout the analysis.

Many factors in an oilfield can alter the total processing rate of a reservoir, thereby invalidating application of conventional rate-time analysis methods to that reservoir. Total processing rate altering factors can include surface operational activities, realignments, workovers, injector and producer well stimulations, pump changes and changes in the mechanism of the oil recovery process. Accordingly, conventional rate-time analysis methods have severe limitations in practice. Fetkovich, M. J., et al, "Useful Concepts for Decline Curve Forecasting, Reserve Estimation and Analysis", SPE 28628, September 1994, discloses a number of techniques that are designed to render rate-time analysis applicable to cases where the total processing rate of the reservoir is variable over time, such as where the reservoir is responding to well stimulations or restimulations.

From the foregoing, it is apparent that a need remains for alternate methods of rate-time analysis to determine the oil decline for an oil-producing reservoir. Accordingly, it is an object of the present invention to provide a method of rate-time analysis for oil-producing reservoirs that is operable under a broad range of production conditions. In particular, it is an object of the present invention to provide a method of rate-time analysis for oil-producing reservoirs that is operable under conditions, wherein the total processing rate of the reservoir either increases or decreases over time. More particularly, it is an object of the present invention to provide a method of rate-time analysis for oil-producing reservoirs that is operable under conditions, wherein the total processing rate of the reservoir varies as the result of operator activities, including workovers, realignments, stimulations, restimulations, recovery process modifications, and the like. It is another object of the present invention to provide a method of accurately determining the oil decline for an oil-producing reservoir from a rate-time analysis. It is still another object of the present invention to provide a method of accurately forecasting the future oil decline for an oil-producing reservoir, thereby providing an accurate estimate of reserves in the reservoir or an accurate forecast of oil production from the reservoir. It is yet another object of the present invention to provide a method of identifying transition periods in production from an oil-producing reservoir, wherein rate-time analysis is inapplicable, thereby insuring application of rate-time analysis only to periods of pseudo steady-state production. It is a further object of the present invention to provide a method of rate-time analysis that enables accurate forecasting of oil and non-oil phase production when there is multi-phase flow in the oil-producing reservoir. These objects and others are accomplished in accordance with the invention described hereafter.

SUMMARY OF THE INVENTION

The present invention is a method of determining a corrected oil decline for an oil-producing reservoir. The method comprises determining the variables, total processing rate for the reservoir at an initial time denoting the beginning of an elapsed production time period and oil processing rate for a given oil saturation level of the reservoir at a first selected time after the initial time. These variables are used to determine the ratio of non-oil fluids to oil for all fluids produced from the reservoir at the first selected time. The ratio of non-oil fluids to oil for all fluids produced from the reservoir at the first selected time and the total processing rate at the initial time are then used to determine the corrected oil processing rate at the selected time. The total processing rate and corrected oil processing rate at the selected time can further be used to determine the corrected non-oil fluid processing rate at the selected time.

A second time after the initial time is selected and the above-recited steps are repeated for this second selected time to determine the corrected oil processing rate at the second selected time. Additional times after the initial time are further selected and the above-recited steps are repeated for each of the additional selected times to determine the corrected oil processing rate at each additional selected time. The corrected oil decline is defined by the locus of the corrected oil processing rates at all of the selected times.

The portion of the corrected oil decline defined by the corrected oil processing rates at selected times within the elapsed production time period represents the elapsed corrected oil decline and can be used to accurately verify or match actual production performance data or, alternatively, can be used to explain discrepancies between the corrected oil decline and the actual production performance data. The portion of the corrected oil decline defined by the corrected oil processing rates at selected times beyond the elapsed production time period into a future production time period represents the future corrected oil decline and can be used to accurately estimate oil reserves or forecast future oil production.

The variable, oil processing rate for a given oil saturation level of the reservoir, can be determined by any one of a number of techniques. A preferred technique is to initially determine the cumulative quantity of total fluid produced between the initial time and the selected time. This cumulative quantity, along with the total and oil processing rates at the initial time and the selected time, is then used to determine the oil processing rate for the given oil saturation. The process of the present invention will be further understood from the following detailed description and accompanying drawings.

DESCRIPTION OF PREFERRED EMBODIMENTS

Figure 1:
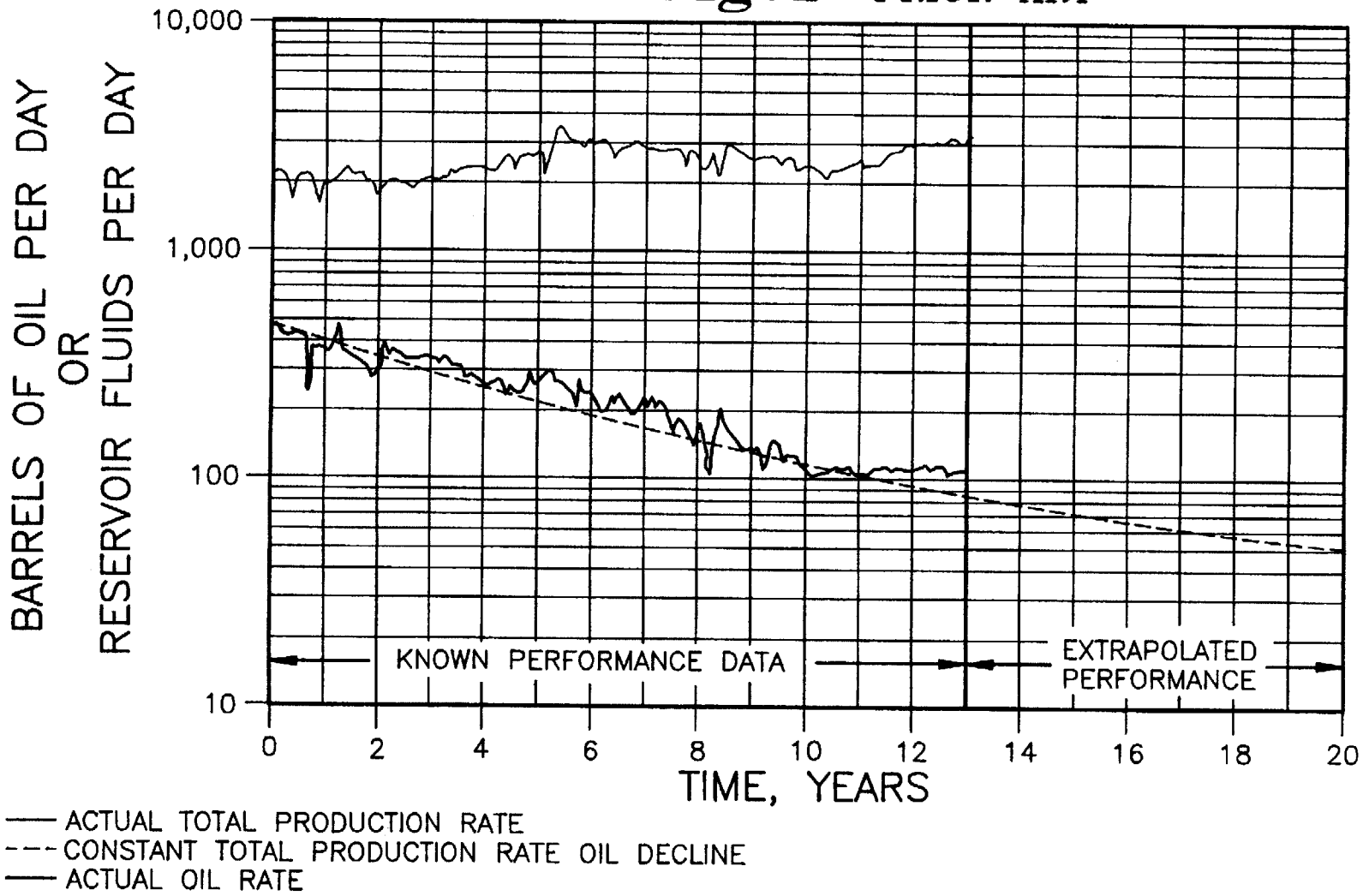
Fig. 1 PRIOR ART
FIG. 1 is a graphical representation of an oil decline prepared in accordance with prior art methods.

The present invention relates to a method of determining the oil decline for an oil-producing reservoir by rate-time analysis, wherein the total processing rate for the reservoir can vary during the time period for which the oil decline is determined without substantially adversely impacting the accuracy of the oil decline. As defined herein, the total processing rate for the reservoir is the rate of all fluid production from the reservoir, including produced oil, any produced reservoir fluids, and any produced injection fluids. The total processing rate is typically a volumetric rate expressed as reservoir volume units per time unit, such as reservoir barrels of fluid produced from the reservoir per day. The production rate for each specific fluid produced from the reservoir is similarly defined as that specific fluid processing rate. For example, the oil processing rate is defined as the volumetric oil production from the reservoir per unit time. It can be appreciated by the skilled artisan, however, that the present method is not limited to any specific units disclosed herein.

The method of the present invention is initiated by selecting an elapsed production time period for the oil producing reservoir of interest, typically several years, wherein a history of actual reservoir production performance data has been obtained from measurements conducted in the field during the selected elapsed production time period. Historical reservoir production performance data applicable to the present method are substantially any field measurements of instantaneous reservoir production sufficient to establish the historical total processing and oil processing rates for the reservoir of interest during the selected elapsed time production period. As such, the production performance data can include actual total processing rate data, actual oil processing rate data, actual water processing rate data and/or actual gas processing rate data obtained from field measurements of instantaneous reservoir production.

A two-dimensional plot of the historical total processing rate is prepared as a function of time for the duration of the elapsed production time period based on the historical reservoir performance data. The y-axis of the plot is preferably the instantaneous fluid processing rate expressed in reservoir units per time unit, such as reservoir barrels per day, and the x-axis is preferably time expressed in conventional units, such as years. A plot of the historical oil processing rate is similarly prepared as a function of time based on the historical reservoir performance data. The historical total processing and oil processing rates are preferably plotted on the same two-dimensional axes such that the plot of the historical oil processing rate is positioned beneath the plot of the historical total processing rate. The distance between the two processing rate plots represents the historical processing rate for all non-oil fluids produced from the reservoir.

The present invention is a method of modeling the plot of the actual oil processing rate over time by mathematically defining a curve in terms of specified production parameters and constants. This curve modeling the plot of rate-time data is termed the corrected oil decline. A portion of the corrected oil decline resides in the elapsed production time period and can be used to accurately verify or match actual production performance data or, alternatively, can be used to explain discrepancies between the oil decline and the actual production performance data. The remaining portion of the corrected oil decline is extrapolated beyond the elapsed production time period into a future production time period and can be used to accurately estimate oil reserves or forecast future oil production. The present method specifically enables correction of the elapsed or future oil decline due to historical fluctuations or future anticipated or subsequently known fluctuations in the total processing rate for the reservoir of interest. The corrected oil decline allows subsequent verification or matching of historical production, estimating of reserves, or forecasting of oil production as well as non-oil phase production in the event of multi-phase flow.

The corrected oil decline is determined mathematically in accordance with the present method from the historical production performance data as applied to the series of equations (1) through (3) set forth below. The following nomenclature applies to equations (1) through (3), as well as to equations (4) and (5) set forth thereafter:

Variables $F_n$=Ratio of non-oil fluids to oil produced from the reservoir q=Fluid processing rate for a given fluid at a given time, where the given fluid and time are identified by appropriate fluid and time subscripts Q=Cumulative total fluid production from time 0 n=Hyperbolic decline exponent value, range of 0 to 1 d=Decline rate as fraction of fluid production decline per unit time a=Constant

Subscripts o=Oil n=Non-oil fluids

T=Total fluids

S=Saturation of oil in reservoir, range of 0 to 1 t=Elapsed time from initial time 0

$$F_{n(t)}=(q_{T(0)}-q_{oS(t)})/q_{oS(t)} \quad (1)$$

$$q_{o(t)}=q_{T(t)}/(1+F_{n(t)}) \quad (2)$$

$$q_{n(t)}=q_{T(t)}-q_{o(t)} \quad (3)$$

The general technique for modeling the oil decline to correct it in correspondence with fluctuations in the actual or predicted total processing rate is initiated by determining the values of the independent variables for Equation 1 set forth above. Values for the independent variable, total processing rate at the initial time 0 which is the beginning of the elapsed production time period, can be either actual values based on physical measurement of production parameters or predicted values based on assumptions of the skilled practitioner. Values for the independent variable, oil processing rate for a given oil saturation level of the reservoir at a selected time t after the initial time, are typically calculated in accordance with a technique described below or in accordance with other means well known to the skilled practitioner. It is noted that the oil processing rate for a given oil saturation level of the reservoir is calculated under identical flow geometry, fluid property, and pressure potential conditions prevailing when the total processing rate at the initial time is established. Once the independent variables for Equation 1 are determined, Equation 1 is solved to calculate the ratio of non-oil fluids to oil produced at the selected time.

This calculated ratio is used with the independent variable, total processing rate at the selected time, in Equation 2 to calculate the corrected oil processing rate at the selected time. Values for the independent variable, total processing rate at the selected time, can be either actual values based on physical measurement of production parameters or predicted values based on assumptions of the skilled practitioner. Thereafter, this calculated value of the corrected oil processing rate can be used with the total processing rate at the selected time in Equation 3 to calculate the instantaneous corrected non-oil fluid processing rate. Although Equation 3 is expressed in terms of a single non-oil fluid, it is apparent to the skilled artisan that equation 3 can be modified to accommodate a plurality of distinguishable non-oil fluids.

As stated above, the variable, oil processing rate for a given oil saturation level of the reservoir, can be determined by any manner available to the skilled practitioner, but is preferably determined in accordance with Equations 4 and 5 as follows:

$$q_{oAS(t)}=q_{o(0)}e^{(-aQ_{T(t)}/q_{T(0)})} \quad (4)$$

Equation 4 applies to an exponential oil decline,

Where $a=-\ln(1-d_{(0)})$ $$q_{oAS(t)}=q_{o(0)}(1+naQ_{T(t)}/q_{T(0)})^{(1/-n)} \quad (5)$$

Equation 5 applies to a hyperbolic oil decline,

Where $a=(1/n)((1-d_{(0)})^{-n}-1)$

It is noted that values for the independent variable, oil processing rate at the initial time, can be either actual values based on physical measurement of production parameters or predicted values based on assumptions of the skilled practitioner. The remaining variables in Equations 4 and 5 are calculated in accordance with generally accepted techniques known to the skilled practitioner. The constants d and n can be determined by history matching existing production performance data, by calculation after explicitly defining the remaining oil reserves, or by any other appropriate method known to the skilled practitioner. It is further noted that the time units for q and d must remain consistent throughout the present method.

After calculating the value of the corrected oil processing rate at the selected time, another time is selected that is after the initial time. The above-recited procedure is repeated for the newly selected time to calculate the value of the corrected oil processing rate at the newly selected time. This procedure is repeated for a plurality of different selected times until a sufficient number of values for the corrected oil processing rate have been determined to define the corrected oil decline.

The following example demonstrates the practice and utility of the present invention, but is not to be construed as limiting the scope thereof.

EXAMPLE

Referring initially to FIG. 1, historical reservoir production performance data are obtained for a reservoir and these data are used to plot the actual total processing rate and actual oil processing rate for an elapsed production time period of about 13 years. A best fit line approximating the oil decline for the elapsed production time period is generated in accordance with methods known in the prior art. The best fit line is extrapolated for a future production time period of about 7 years beyond the elapsed production time period, thereby forecasting the oil decline for the future production time period.

Figure 2:
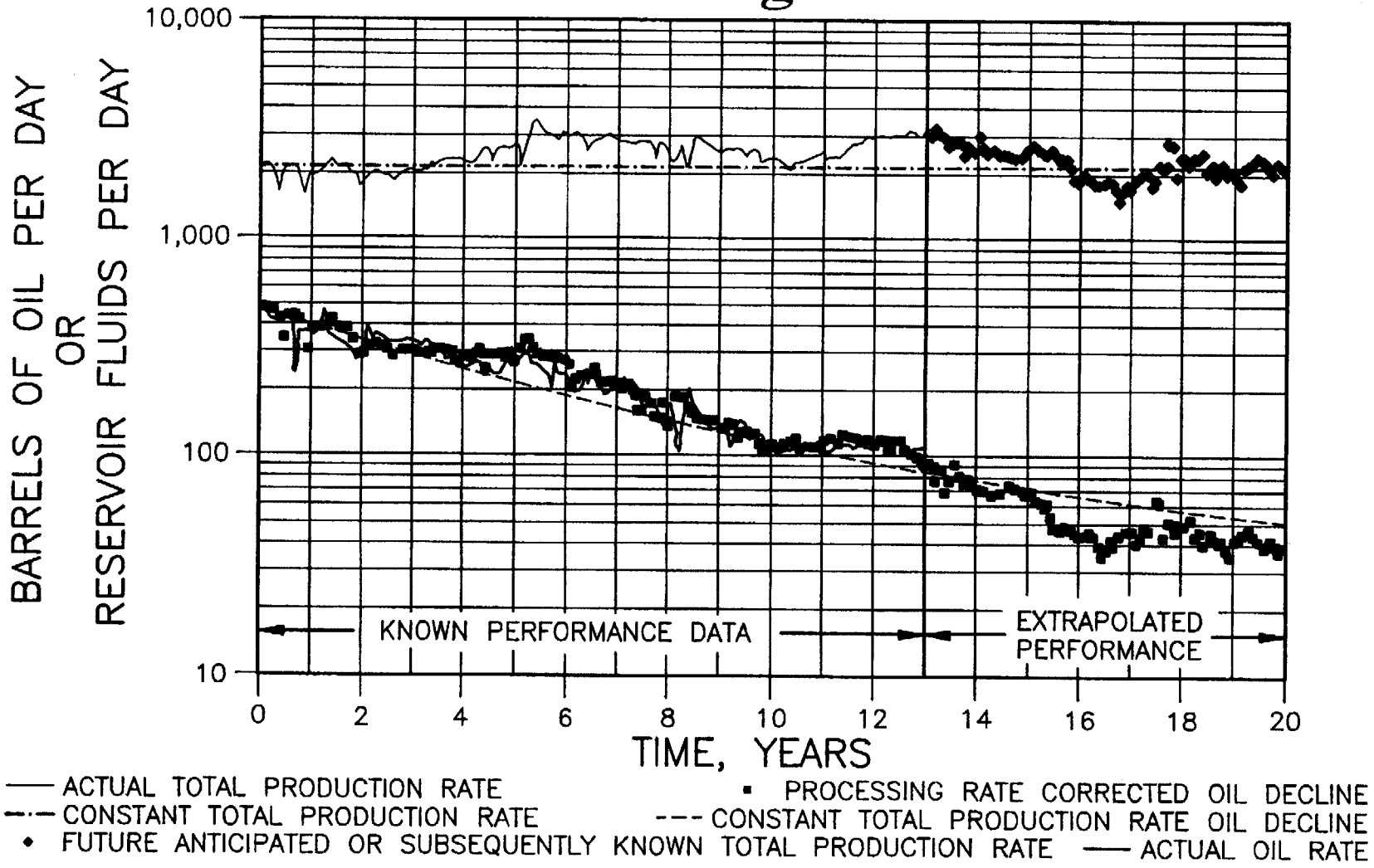
FIG. 2 is a graphical representation of a corrected oil decline prepared in accordance with the method of the present invention.

Referring to FIG. 2, the historical reservoir production performance data are used to calculate the corrected oil decline for the same reservoir during the elapsed production time period in accordance with the method of the present invention. This may require iteratively modifying the form or constants of the function that yields the oil processing rate for a given oil saturation level of the reservoir until a suitable reproduction of the actual oil processing rate is achieved. If Equations 4 and 5 are used for this calculation, the values of n, d, and the total and oil processing rates at the initial time are modified until a suitable reproduction of the actual oil processing rate is achieved. A plot of the corrected oil decline is superimposed onto the best fit line oil decline for comparison. The total processing rate is then predicted for the future production time period based on anticipated changes in total fluid production due to application of different oil recovery processes or other factors well known to the skilled artisan. The corrected oil decline is calculated for the future production time period in accordance with the method of the present invention and a plot of the future corrected oil decline is similarly superimposed on the best fit line oil decline.

It is apparent from FIG. 2 that the corrected oil decline of the present invention more accurately matches the historical production performance of the reservoir and forecasts the production performance than the best fit line oil decline of the prior art, particularly where there are anticipated or subsequently known fluctuations in the future total processing rate.

While foregoing preferred embodiments of the invention have been described and shown, it is understood that alternatives and modifications, such as those suggested and others, may be made thereto and fall within the scope of the invention.

I claim:

1. A method of evaluating oil production performance of an oil-bearing reservoir using a corrected oil processing rate determined for said oil-bearing reservoir comprising:

a) determining a total processing rate for said oil-bearing reservoir at an initial time;

b) determining a total processing rate for said reservoir at a selected time after said initial time;

c) determining an oil processing rate for an oil saturation level of said reservoir at said selected time;

d) determining a ratio of non-oil fluids to oil for all fluids produced from said reservoir at said selected time;

e) determining a corrected oil processing rate at said selected time using said ratio of non-oil fluids to oil and said total processing rate at said selected time;

f) producing oil from said reservoir at said selected time;

g) measuring said actual oil processing rate at said selected time; and h) comparing said actual oil processing rate to said corrected oil processing rate to evaluate said oil production performance of said reservoir.

2. The method of claim 1 further comprising determining a cumulative quantity of total fluid produced from said reservoir between said initial time and said selected time.

3. The method of claim 2 further comprising determining an oil processing rate for said reservoir at said initial time.

4. The method of claim 3 wherein said oil processing rate for said oil saturation level of said reservoir at said selected time is determined using said total processing rate at said initial time, said oil processing rate at said initial time and said cumulative quantity of total fluid produced between said initial time and said selected time.

5. The method of claim 1 wherein said ratio of non-oil fluids to oil is determined using said total processing rate at said initial time and said oil processing rate for said oil saturation level of said reservoir at said selected time.

6. The method of claim 1 further comprising determining a corrected non-oil fluid processing rate for said reservoir at said selected time.

7. The method of claim 6 wherein said corrected non-oil fluid processing rate at said selected time is determined using said total processing rate at said selected time and said oil processing rate at said selected time.

8. The method of claim 1 wherein said selected time is a first selected time and further comprising selecting a second time after said initial time and repeating steps b) through e).

9. The method of claim 8 further comprising determining a corrected oil decline defined by said corrected oil processing rate at said first selected time and a corrected oil processing rate at said second selected time.

10. The method of claim 9 further comprising, producing oil from said reservoir between said first selected time and said second selected time;

measuring said actual oil processing rates between said first selected time and said second selected time; and comparing said actual oil processing rates to said corrected oil decline to evaluate said oil production performance of said reservoir.

11. The method of claim 1 wherein said total processing rate at said selected time is an actual rate.

12. The method of claim 1 wherein said total processing rate at said selected time is a predicted rate.

13. A method of evaluating oil production performance of an oil-bearing reservoir using a corrected oil decline rate determined for said oil-bearing reservoir comprising:

a) determining a total processing rate for said oil-bearing reservoir at an initial time;

b) determining a total processing rate for said reservoir at a selected time after said initial time;

c) determining an oil processing rate for an oil saturation level of said reservoir at said first selected time;

d) determining a ratio of non-oil fluids to oil for all fluids produced from said reservoir at said selected first time;

e) determining a corrected oil processing rate at said selected time using said ratio of non-oil fluids to oil and said total processing rate at said selected time;

f) selecting a second time after said initial time and repeating steps b) through e);

g) determining a corrected oil decline defined by said corrected oil processing rate at said first selected time and a corrected oil processing rate at said second selected time;

h) producing oil from said reservoir from said first selected time to said second selected time;

i) measuring said actual oil processing rates from said first selected time to said second selected time; and j) comparing said actual oil processing rates to said corrected oil decline to evaluate said oil production performance of said reservoir.

14. The method of claim 13 further comprising determining a cumulative quantity of total fluid produced from said reservoir between said initial time and said first selected time.

15. The method of claim 14 further comprising determining an oil processing rate for said reservoir at said initial time.

16. The method of claim 15 wherein said oil processing rate for said oil saturation level of said reservoir at said first selected time is determined using said total processing rate at said initial time, said oil processing rate at said initial time and said cumulative quantity of total fluid produced between said initial time and said first selected time.

17. The method of claim 13 wherein said ratio of non-oil fluids to oil is determined using said total processing rate at said initial time and said oil processing rate for said oil saturation level of said reservoir at said selected time.

18. A method of evaluating oil production performance of an oil-bearing reservoir using a corrected oil processing rate determined for said oil-bearing reservoir comprising:

a) determining a total processing rate for an oil-producing reservoir at an initial time, $q_{T(0)}$;

b) determining a total processing rate for said reservoir at a selected time after said initial time, $q_{T(t)}$;

c) determining an oil processing rate for an oil saturation level of said reservoir at said selected time, $q_{oIS(t)}$;

d) determining a ratio of non-oil fluids to oil for all fluids produced from said reservoir at said selected time, $F_n$;

e) determining a corrected oil processing rate at said selected time $q_{o(t)}$ by means of a corrected oil processing rate equation;

$$q_{o(t)}=q_{T(t)}/(1+F_{n(t)})$$

f) producing oil from said reservoir at said selected time;

g) measuring said actual oil processing rate at said selected time; and h) comparing said actual oil processing rate to said corrected oil processing rate $q_{o(t)}$ to evaluate said oil production performance of said reservoir.

19. The method of claim 18 further comprising determining a cumulative quantity of total fluid produced from said reservoir between said initial time and said selected time, $Q_{T(t)}$.

20. The method of claim 19 further comprising determining an oil processing rate for said reservoir at said initial time, $q_{o(0)}$.

21. The method of claim 20 wherein said oil processing rate for said oil saturation level of said reservoir at said selected time $q_{oIS(t)}$ is determined by means of a first oil processing rate for said oil saturation level equation $$q_{oIS(t)}=q_{o(0)}e^{(-aQ_{T(t)}/q_{T(0)})}$$

and a second oil processing rate for said oil saturation level equation $$q_{oIS(t)}=q_{o(0)}(1+naQ_{T(t)}/q_{T(0)})^{(1/-n)}.$$

22. The method of claim 18 wherein said ratio of non-oil fluids to oil is determined by means of a ratio of non-oil fluids to oil equation $$F_{n(t)}=(q_{T(0)}-q_{oIS(t)})/q_{oIS(t)}.$$

23. The method of claim 18 further comprising determining a corrected non-oil fluid processing rate for said reservoir at said selected time, $q_{n(t)}$.

24. The method of claim 23 wherein said corrected non-oil fluid processing rate at said selected time $q_{n(t)}$ is determined by means of a corrected non-oil fluid processing rate equation $$q_{n(t)}=q_{T(t)}-q_{o(t)}.$$

25. The method of claim 18 wherein said selected time is a first selected time and further comprising selecting a second time after said initial time and repeating steps b) through e).

26. The method of claim 25 further comprising determining a corrected oil decline defined by said corrected oil processing rate at said first selected time and a corrected oil processing rate at said second selected time.

27. The method of claim 26 further comprising, producing oil from said reservoir between said first selected time and said second selected time;

measuring said actual oil processing rates between said first selected time and said second selected time; and comparing said actual oil processing rates to said corrected oil decline to evaluate said oil production performance of said reservoir.

* * * * *